United States Patent [19]

Welsch

[11] 4,392,333

[45] Jul. 12, 1983

[54] GUIDE WHEELS FOR BELT GRINDER

[75] Inventor: Walter N. Welsch, Tonawanda, N.Y.

[73] Assignee: Dynabrade, Inc., Tonawanda, N.Y.

[21] Appl. No.: 293,096

[22] Filed: Aug. 17, 1981

[51] Int. Cl.[3] ..... B24B 23/06

[52] U.S. Cl. ..... 51/170 EB

[58] Field of Search ..... 51/170 EB, 170 R, 170 PT, 51/174, 176

[56] References Cited

U.S. PATENT DOCUMENTS

| | | | |
|---|---|---|---|
| 1,727,524 | 9/1929 | Spencer | 51/176 |
| 1,917,906 | 7/1933 | Schulte | 51/170 PT |
| 3,427,757 | 2/1969 | Redman | 51/170 EB |
| 3,648,413 | 3/1972 | Godwin | 51/170 PT |
| 4,178,723 | 12/1979 | Fleckenstein et al. | 51/170 EB |

*Primary Examiner*—Roscoe V. Parker

*Attorney, Agent, or Firm*—Bean, Kauffman & Bean

[57] ABSTRACT

A pair of guide wheels are provided for a manually manipulated abrading device of the endless abrasive belt variety for preventing the gouging of the surface of a workpiece when a raised imperfection, such as a weld bead, is abraded by operation of the belt to lie flush with such surface. The guide wheels define an annular and radially outwardly opening groove in which a tire formed of a relatively non-deformable material is supported to undergo relative radially directed displacements incident to rolling of the tire along the surface of the workpiece. The guide wheels are adjustable to vary the width of the groove for purposes of controlling the extent of radially directed displacements of the tire, and thus the position of the belt relative to the surface of the workpiece.

5 Claims, 5 Drawing Figures

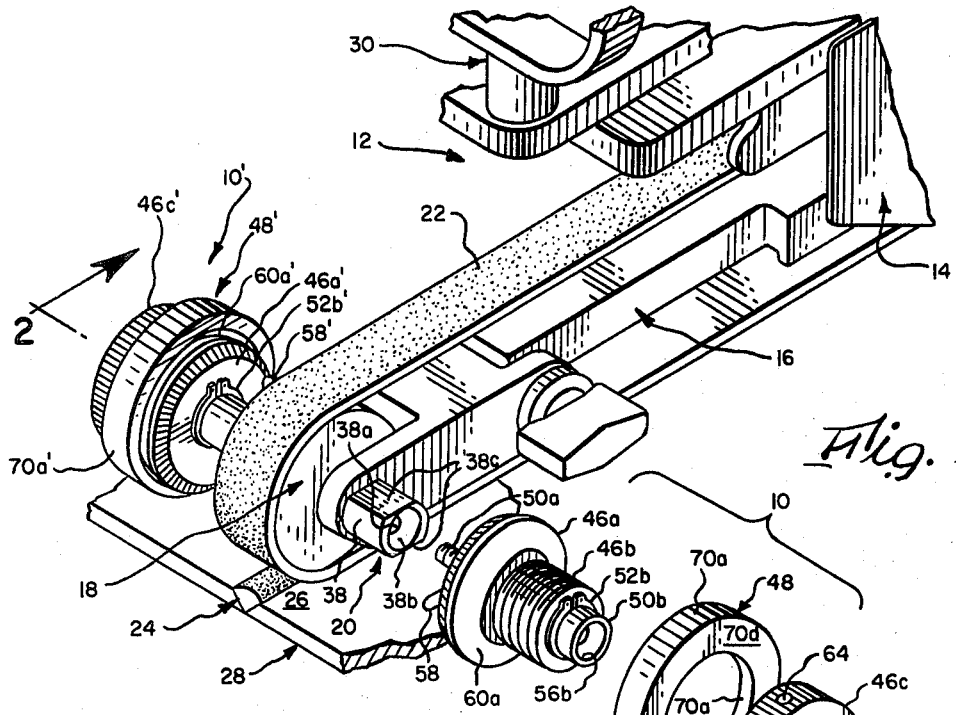
Fig. 1.
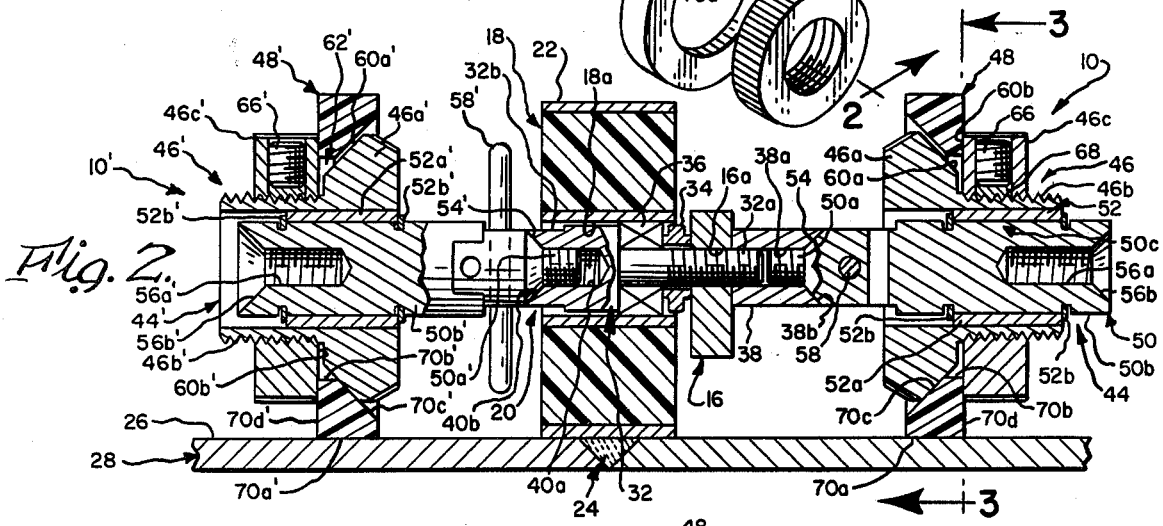
Fig. 2.
Fig. 3.
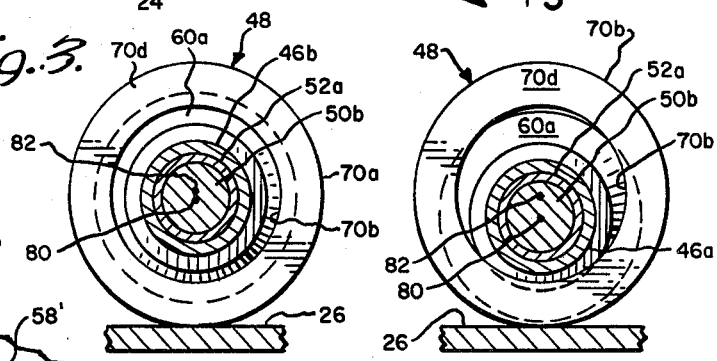
Fig. 4.
Fig. 5.
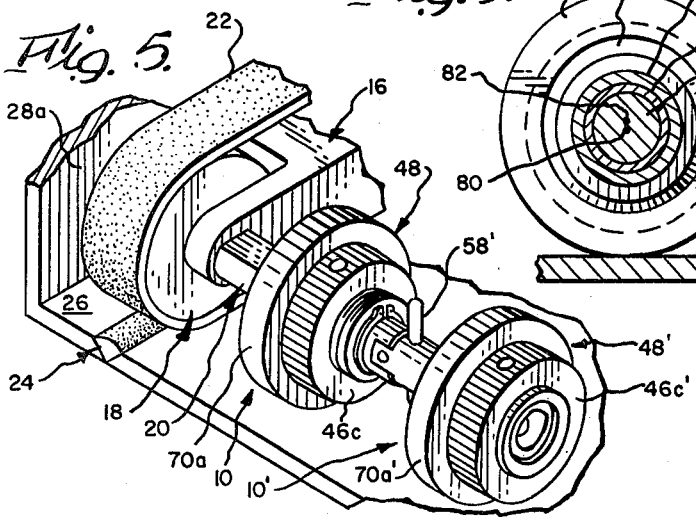

GUIDE WHEELS FOR BELT GRINDER

BACKGROUND OF THE INVENTION

The present invention generally relates to a guide device particularly adapted for use in connection with a manually manipulatable abrading device of the endless belt variety in order to prevent gouging of the surface of a workpiece when a raised imperfection in such workpiece is abraded to lie essentially flush with such surface. More particularly, the present invention relates to an improvement in a guide of the type disclosed in commonly assigned U.S. Pat. No. 4,178,723.

The guide device disclosed in U.S. Pat. No. 4,178,723 is characterized as comprising one or more circumferentially expandable guide wheels, which are mounted coaxially with a contact wheel over which an abrasive belt passes while in contact with a workpiece. Specifically, each guide wheel includes a continuous guide ring or tire formed of a resiliently deformable material and means to support and adjustably effect changes in the radius of the guide ring, as required to compensate for variations in thickness of the abrasive belt either due to wear or the utilization of belts of differing thickness.

It has been found that in certain grinding operations, as for instance where a user exerts substantial bearing pressure on the abrasive belt in a non-uniform manner, that slight gouging of the surface of a workpiece occurs incident to non-uniform compression of the resiliently deformable tires, as the grinder is moved along a weld. Attempts to avoid this problem by the simple expedient of reducing the degree of resiliency of the guide ring or tire to a point where gouging of the workpiece surface will not occur as a result in expected fluctuations in bearing pressure, have not met with success, since the guide wheel or tire then loses resiliency to a point where same can not be readily adjusted.

SUMMARY OF THE INVENTION

The present invention is directed towards an improved guide device adapted to prevent gouging of the surface of a workpiece incident to the application of non-uniform bearing loads to a manually manipulatable abrading device. More specifically, the present invention is particularly adapted for use with an endless belt abrading device of the type in which an abrasive belt is trained over a contact wheel, and features the provision of a pair of guide wheels mounted coaxially of the contact wheel for selectively controlling the position of the belt relative to the surface of a workpiece.

The guide wheels of the present invention are characterized as including non-deformable tires, which are supported to undergo radially directed displacements relative to the axis of their associated guide wheel incident to rolling of the tires along the surface of the workpiece. The guide wheels are adjustable to selectively vary the extent of radially directed displacements of the tires, and thus to selectively vary the position of the belt relative to the surface of the workpiece.

In a preferred construction, the guide wheels are selectively/removably fixed to axially opposite ends of the contact wheel and/or each other to permit mounting of the guide wheels in a straddling or axially offset relationship to the contact wheel.

BRIEF DESCRIPTION OF THE DRAWINGS

The present invention may be better understood and its numerous objects and advantages will become apparent to those skilled in the art by reference to the accompanying drawings, wherein like reference numerals refer to like elements in the several figures and in which:

FIG. 1 is a perspective view of an endless belt grinding device generally illustrating the guide wheels of the present invention;

FIG. 2 is a cross-sectional view of the guide wheels and contact wheel of the grinding device illustrated in FIG. 1 and taken generally along the line 2—2;

FIG. 3 is a sectional view taken generally along the line 3—3 in FIG. 2;

FIG. 4 is a sectional view similar to FIG. 3, but showing a guide wheel in another adjusted condition; and FIG. 5 is a perspective view illustrating the utilization of a pair of guide wheels disposed on the same side of or in an axially offset relationship relative to the contact wheel.

DESCRIPTION OF THE BEST MODE OF THE INVENTION

While the invention is susceptible of various modifications and alternative constructions, there is shown in the drawings and there will hereinafter be described a preferred form of the invention. It is to be understood, however, that the specific description and drawings are not intended to limit the invention to the specific form disclosed. On the contrary, it is intended that the scope of this patent include all modifications and alternative constructions thereof falling within the spirit and scope of the invention, as expressed in the appended claims to the full range of their equivalents.

Reference is now made to FIG. 1, wherein the guide device of the present invention is shown as including a pair of guide wheels 10 and 10', which are arranged in association with a hand manipulated, endless abrasive belt type abrading device or grinder 12. It will be understood that abrading device 12 may be of conventional construction from the standpoint that it includes a hand held or manipulated belt drive unit 14, which houses a drive wheel, not shown, coupled for driven rotation under the control of a suitable pneumatic or electric drive motor, also not shown; a contact arm 16, which is arranged to extend forwardly of unit 14; and a contact wheel 18, which is journaled on the outer end of arm 16 by means of an axle 20 and cooperates with the drive wheel to support an endless abrasive belt 22.

As indicated in FIG. 1, abrading device 12 is particularly adapted for use in grinding a weld bead or other projection 24, which upstands from the planar surface 26 of a workpiece 28 in order to reduce same to lie flush with such surface. However, it will be understood that abrading device 12 may also be of the type possessing utility in grinding a weld bead or the like extending circumferentially of the inner or outer surface of a cylindrical workpiece, when fitted with guide wheels formed in accordance with the present invention. If desired, unit 14 may be fitted with a handle 30 to assist in the application of manual or fixed weight applied pressure for use in urging belt 22 into surface to surface contact with weld bead 24. Further, abrading device 12 may be fitted with additional wheels, not shown, which are associated with drive unit 14 and cooperate with guide wheels 10 and 10' to support the abrading device to roll along the surface of a workpiece with only a portion of the downwardly facing surface of contact wheel 18 being effective to apply working pressure to belt 22. Alternatively, abrading device 12 may be hand held and guide wheels 10 and 10' employed to prevent gouging of a workpiece, as the device is manipulated to employ any portion of the contact wheel over which belt 22 is trained to apply working pressure to the belt.

In accordance with the preferred form of the present invention, otherwise conventional grinding device 12 is modified by constructing its axle 20 in the manner shown in FIG. 2, such as to permit wheels 10 and 10' to be selectively removably attached to its axially opposite ends. Specifically, axle 20 preferably includes a stepped diameter hub portion 32 having a threaded shank end portion 32*a* sized to be removably received within a bore opening 16*a* formed in the outer end of contact arm 16 and a head end portion 32*b* sized to be loosely received within through bore opening 18*a* in contact wheel 18; a spacer ring 34 removably supported on shank portion 32*a;* a suitable bearing device 36 supported on shank portion 32*a* intermediate head end portion 32*b* and spacer ring 34 for providing a journal support for contact wheel 18; and a mounting sleeve 38, which has its inner surface or mounting opening 38*a* threaded to receive shank end portion 32*a* and cooperates with head end portion 32*b* to releasably clamp contact arm 16, spacer ring 34 and bearing device 36 in an axially stacked relationship. By referring to FIGS. 1 and 2, it will be noted that the outer end of threaded opening 38*a* is flared outwardly to define a generally frusto-conically shaped inlet surface 38*b* and that the outer surface of mounting sleeve 38 is formed with flattened areas 38*c* in order to facilitate application of a wrench or the like to the mounting sleeve for tightening purposes. Also, by again referring to FIG. 2, it will be noted that head end portion 32*b* is formed with a threaded mounting opening 40*a,* which is disposed in axial alignment with shank portion 32*a* and has its outer end flared outwardly to define a generally frusto-conically shaped inlet surface 40*b.*

By again making reference primarily to FIG. 2, it will be understood that guide wheels 10 and 10' are of similar construction. Accordingly, only guide wheel 10 will be specifically described and like primed numerals applied to like parts of guide wheel 10'. More specifically, guide wheel 10 includes an axle portion 44, which is adapted to be removably fixed to and extend coaxially of axle 20; a wheel portion 46 adapted to be rotatably supported by the axle portion; and a tire 48. Axle portion 44 preferably includes a stepped diameter hub portion 50 having a threaded shank end portion 50*a* sized to be threadably received within mounting opening 38*a;* a head end portion 50*b* sized to be loosely received within wheel portion 46; and a suitable bearing device 50*c* for providing a journal support for the wheel portion. If desired, bearing device 50*c* may simply comprise a bearing sleeve 52*a,* which is force fitted within wheel portion 46 and arranged to rotatably engage with the outer surface of head end portion 50*b* intermediate suitable end constraints, such as afforded by snap rings 52*b* and 52*b.* Also by referring to FIG. 2, it will be seen that head end portion 50*b* tapers outwardly from adjacent shank end portion 50*a* to define a generally frusto-conically shaped guide surface 54 intended to be placed in full surface to surface engagement with inlet surface 38*b* upon the threading of shank end portion 50*a* into opening 38*a* in order to better insure that axle portion 44 is mounted in axial alignment with axle 20. The opposite end of head end portion 50*b* is provided with a threaded mounting opening 56*a,* which is sized to selectively receive shank end portion 50*a'* and has its outlet end flared to define a generally frusto-conically shaped inlet guide surface 56*b,* which in turn is adapted for surface to surface engagement with surface 54'. Head end portion 50*b* may be fitted with suitable means, such as may include a pin or arm 58, to facilitate removable threading of shank end portion 50*a* within mounting opening 38*a* for guide wheel mounting/removal purposes.

In a preferred form of the invention, axle 20 and axle portions 44 and 44' are constructed in order to permit wheels 10 and 10' to be selectively/removably fixed to axially opposite ends of axle 20, as well as to each other. More specifically, by forming axle 20 and axle portions 46 and 46' of guide wheels 10 and 10' in the manner described above, the guide wheels may be positioned in a straddling relationship relative to contact wheel 18 in the manner shown in FIGS. 1 and 2 in order to provide balance for abrading device 12 and insure against tilting of the axis of the contact wheel 18 relative to workpiece surface 26. Alternatively, the guide wheels may be both positioned on one or the other of the axially opposite ends of contact wheel 18, when for instance weld bead 24 is disposed in close proximity to a flange or weldment 28*a,* which upstands from the surface of workpiece 26 in the manner shown for example in FIG. 5. Preferably, handle 30 would be supported on unit 14, such as to permit its being swung from a normal position disposed in substantial alignment with contact wheel 18 selectively into positions on opposite sides thereof for substantial alignment with the guide wheels when both are positioned on one side or the other of the contact wheel.

Wheel portion 46 is shown in the drawings as including a first wheel part 46*a,* which includes an externally threaded sleeve 46*b* supported for rotation concentrically of the axis of axle portion 44 by bearing device 50*c;* and a second wheel part 46*c,* which is in the form of an internally threaded ring supported by sleeve 46*b* for adjustment axially thereof. First and second wheel parts 46*a* and 46*c* are characterized as having annularly extending supporting and positioning surfaces 60*a* and 60*b,* respectively, which cooperate to define a radially outwardly opening and circumferentially extending mounting groove 62 disposed concentrically of the axis of axle portion 44. In the illustrated construction, supporting surface 60*a* is shown as being of frusto-conical configuration and positioning surface 60*b* is shown as being planar and radially disposed with the result that the surfaces of the mounting groove radially outwardly diverge. Alternatively, if desired, both surfaces 60*a* and 60*b* may be of frusto-conical configuration in a manner similar to that described in U.S. Pat. No. 4,178,723. By viewing FIG. 2, it will be understood that the axial dimension or width of the groove 62 may be selectively adjusted by threading second ring member 46*c* axially of sleeve 46*b,* and the second ring member fixed in a selected adjusted position by means of a set screw 64 releasably bearing on the threads of such sleeve via a motion snubbing plug 68 formed of a suitable plastic material, such as urethane. It will also be understood that groove 62 may be considered as having a maximum diameter, which corresponds to the maximum diameter of wheel portion 46, and a minimum diameter, which may be variously defined, but in the illustrated construction corresponds to the diameter of sleeve 46*b.*

Tire 48 is shown as being positionally located within groove 62 and as being bounded by an outer or workpiece engaging surface 70*a,* a concentrically arranged through opening or inner surface 70*b* and axially oppositely facing side supporting and positioning surface portions 70c and 70d, respectively. Preferably, surface portions 70c and 70d have configurations corresponding essentially to that of supporting and positioning surfaces 60a and 60b with which they are respectively arranged to engage. As will be apparent from viewing FIGS. 2–4, the diameter of workpiece engaging surface 70a exceeds the maximum diameter of groove 62, whereas the diameter of the through opening 70b is less than such maximum diameter, but greater than the minimum diameter of such groove, thereby to permit tire 48 to undergo movement or be subject to displacements within the groove transversely of the axis of axle portion 44, as the tire rolls along surface 26. Preferably, tire 48 is formed of a plastic material, such as urethane having a Shore value of 90 durometer, which is relatively non-deformable under expected working pressures. This will be compared to the relatively soft tires utilized in the commercial form of the invention described in U.S. Pat. No. 4,178,723, which are fabricated from urethane of about 60 durometer and necessarily subject to resilient deformation during use. Although the tires of the present invention are relatively hard, they nonetheless retain a relatively high coefficient of friction, while engaged with workpiece surface 26, in order to prevent undesired sliding displacements of contact wheel 18 and belt 22 transversely of weld bead 24, during the grinding operation. Alternatively, tires may be formed of other materials, including steel, which if desired, may have its workpiece engaging surface roughened or coated with plastic material to enhance tracking of abrading device 12 along the weld bead.

By now referring specifically to FIGS. 3 and 4, wherein the aligned axes of axle 20 and axle portion 44 are designated as 80 and the axis of tire 48 is designated as 82, it will be apparent that when the outer surface 70a of tire 48 is placed in rolling engagement with workpiece surface 26, there is a tendency for the tire to move or be displaced vertically within groove 62, until it bottoms out upon engagement of its surfaces 70c and 70d with surfaces 60a and 60b at points vertically adjacent the point of engagement of outer surface of the tire with the workpiece. The amount of such displacement or the extent to which separation occurs between axes 80 and 82 will depend upon the width of groove 62, which is in turn determined by the adjusted position of second wheel member 46c axially of sleeve 46b. In the illustrated construction, it is possible to move second wheel member 46c towards first wheel member 46a into a first limiting position, not shown, wherein surface portions 70c and 70d engage throughout their circumferential extent with surfaces 60a and 60b, respectively, such that tire 48 is constrained from transverse displacement and axes 80 and 82 disposed in alignment. In this adjusted position of second wheel member 46c, wheel 10 assumes its maximum effective working diameter, wherein tire outer surface 70a is spaced a given maximum distance from axis 80, as measured from adjacent the point of contact of the tire outer surface with the workpiece. As second ring member 46c is backed off or moved to the right as viewed in FIG. 2, the width of mounting groove 62 is increased and tire 48 thereby permitted to move relatively inwardly of the mounting groove from adjacent its point of contact with the workpiece, such that tire axis 82 becomes displaced relative to the axis of rotation 80, as best seen from viewing FIG. 3. As the backing off of second ring member 46c continues, the width of mounting groove 62 will be progressively increased, so as to permit further transverse displacement of the tire, until such time as outer surface of wheel portion 46 contacts the workpiece and tire outer surface 70a lies coplanar therewith at the point of contact. This defines a second limiting position, wherein wheel 10 assumes its minimum effecting working diameter, and tire surface 70a is spaced a given minimum distance from axis 80, as measured from adjacent its point of contact with the workpiece. As a practical matter it would be preferable to not back off second wheel member 46c beyond some point, such as that generally illustrated in FIG. 4, wherein tire 48 serves to maintain a slight separation or spacing between the outer surface of wheel portion 46 and the workpiece, and wherein sufficient contact is maintained between surface portions 70c and 70d and surfaces 60a and 60b to constrain tire 48 from wobbling or its axis from canting within groove 62 under working conditions. In like manner, it would be preferable to not thread second wheel member 46c into the first limiting position, since there would be a tendency for the fully engaged surfaces of the tire and wheel members to "grab" and make difficult subsequent unthreading of the second wheel member.

From the foregoing, it will be apparent that second wheel members 46c and 46c' may be selectively adjusted to vary the effective working diameter of wheels 10 and 10', as required to support contact wheel 18 relative to workpiece surface 26 in a manner insuring that abrasive belt 22, when trained over the contact wheel, will grind weld bead 24 to lie flush with the workpiece surface. The utilization of a tire forming material, which is essentially non-deformable under expected working pressures, insures that the axis of contact wheel 18 will be maintained at a uniform distance from workpiece surface 26, as tires 48 and 48' roll therealong, in order to prevent gouging or non-uniform abrading of such surface.

With the present construction, the effective working diameter of wheels 10 and 10' may be subject to substantial adjustment, so as to accommodate for variance in contact wheel diameters, as well as variance in thickness of the abrasive belts to be employed in a grinding operation.

I claim:

1. Guide means for an abrading device of the type having an endless abrasive belt trained over a contact wheel supported for rotation about an axis, said guide means including wheel means for guiding said contact wheel relative to the surface of a workpiece engaged by said belt while passing over said contact wheel, said wheel means defining an annularly extending groove disposed concentrically of said axis and bounded by radially outwardly divergent surfaces, said groove being characterized as having a maximum diameter and a minimum diameter, said wheel means being adjustable to selectively vary the width of said groove in a direction aligned with said axis; and a tire received within said groove, said tire being formed of a relatively rigid material and having an outer surface for engaging said workpiece, a concentrically arranged through opening and opposite side surface portions extending between said outer surface and said through opening and arranged for engagement with said surfaces of said groove, said outer surface having a diameter exceeding said maximum diameter, said through opening having a diameter less than said maximum diameter, while exceeding said minimum diameter by an amount permitting displacement of said tire transversely of said axis incident to engagement of said outer surface with said workpiece, characterized in that said width of said groove determines the extent of said displacements of said tire.

2. Guide means for an abrading device of the type having an endless abrasive belt trained over a contact wheel supported for rotation about an axis, said guide means including a wheel portion; an axle portion for supporting said wheel portion for rotation about an axis aligned with the first said axis, said wheel portion including a first wheel member journaled on said axle portion and a second wheel member, said first and second wheel members having annularly extending and radially outwardly diverging facing surfaces cooperating to bound an annular groove disposed concentrically of said axis of rotation of said wheel portion, said groove having a maximum diameter and a minimum diameter, said second wheel member being supported by said first wheel member for adjustment in a direction aligned with said axis of rotation of said wheel portion for varying the width of said groove as measured between said facing surfaces; and a tire formed of a material characterized as being relatively non-deformable under working pressure to be applied to said abrading device, said tire being received within said groove and having an outer surface for engaging said workpiece, a concentrically arranged through opening and opposite side surface portions extending between said outer surface and said through opening, said side surface portions being arranged for engagement with said facing surfaces of said groove, said outer surface having a diameter exceeding said maximum diameter, said through opening having a diameter less than said maximum diameter, while exceeding said minimum diameter by an amount permitting displacements of said tire transversely of said axis of rotation of said wheel portion incident to engagement of said outer surface with said workpiece, characterized in that said width of said groove determines the extent of said displacements of said tire.

3. Guide means for an abrading device of the type having an endless abrasive belt trained over a contact wheel providing support for said belt at the point of contact thereof with a workpiece, said contact wheel being supported by an axle for rotation about an axis, characterized in that said guide means includes a pair of wheel means, each of said wheel means including an axle portion fixed to an end of said axle to extend coaxially therewith, a wheel portion having a first wheel member journaled by said axle portion for rotation about an axis aligned with the first said axis and a second wheel member adjustably supported by said first wheel member for movement in a direction aligned with said axis of rotation of said first wheel member, said first and second wheel members having annularly extending and radially outwardly diverging facing surfaces cooperating to define a groove disposed concentrically of said axis of rotation of said first wheel member, said groove having a maximum diameter, a minimum diameter and a width as measured between said facing surfaces variable in response to adjustment of said second wheel member relative to said first wheel member, and a tire received within said groove, said tire being formed of a relatively rigid material and having an outer surface for engaging said workpiece, a concentrically arranged through opening and opposite side surface portions extending between said outer surface and said through opening and arranged for engagement with said facing surfaces of said groove, said outer surface having a diameter exceeding said maximum diameter, said through opening having a diameter less than said maximum diameter, while exceeding said minimum diameter by an amount permitting displacements of said tire transversely of said axis of rotation of said first wheel member incident to engagement of said outer surface with said workpiece, and further characterized in that said width of said groove determines the extent of said displacements of said tire.

4. A guide device according to claim 3, wherein each said axle portion is characterized as having mounting means located at axially opposite ends thereof for permitting each said axle portion to be selectively removably fixed to opposite ends of said axle for positioning said pair of wheel means in a straddling relationship to said contact wheel and to each other for positioning said pair of wheel means adjacent either of said opposite ends of said axle.

5. A guide means according to claim 3, wherein axially opposite ends of said axle are provided with aligned threaded mounting openings and each said axle portion is provided with a threaded mounting opening at one end thereof and a threaded shank end portion adjacent an opposite end thereof, said mounting opening and shank end portion of each said axle portion being disposed in axial alignment, and said shank end portion of each said axle portion being selectively and removably received within either of said mounting openings of said axle or said mounting opening of the other said axle portion.

* * * * *